United States Patent [19]

Fendley et al.

[11] Patent Number: 4,716,334

[45] Date of Patent: Dec. 29, 1987

[54] FACEPLATE ASSEMBLY FOR SECURING A TENSION MASK SUPPORT STRUCTURE TO A FACEPLATE

[75] Inventors: James R. Fendley, Arlington Heights; Siegfried M. Greiner, Crystal Lake, both of Ill.

[73] Assignee: Zenith Electronics Corporation, Glenview, Ill.

[21] Appl. No.: 925,424

[22] Filed: Oct. 31, 1986

[51] Int. Cl.[4] ..... H01J 29/07

[52] U.S. Cl. ..... 313/407; 313/408

[58] Field of Search ..... 313/402, 407, 408

[56] References Cited

U.S. PATENT DOCUMENTS 3,695,860 10/1972 Katuta ..... 65/164
3,890,526 6/1975 Palac ..... 313/408
4,595,857 6/1986 Rowe et al. ..... 313/477 R X

FOREIGN PATENT DOCUMENTS 2052148 11/1981 United Kingdom ..... 313/408

OTHER PUBLICATIONS

David Surgan, "Sealed With a Kilovolt", The Electronic Engineer, Sep. 1968.

Daniel I. Pomerantz, Mallory Laboratory for Physical Science, Burlington, Mass., Glass to Metal Ceramic Seal.

*Primary Examiner*—Leo H. Boudreau
*Assistant Examiner*—Sandra L. O'Shea
*Attorney, Agent, or Firm*—Ralph E. Clarke, Jr.

[57] ABSTRACT

A faceplate assembly is disclosed for a color cathode ray tube comprising a glass faceplate having on its inner surface a centrally disposed phosphor screen. A foil shadow mask is mounted in tension on a mask support structure which is located on opposed sides of the screen. The mask support structure physically penetrates the faceplate for permanent, cementless anchoring of the structure to the faceplate. The embedment of the mask support structure is of such depth as to cause the structure to resist tensile forces created by the mask. Also disclosed is a process for securing a support structure for a tensed foil shadow mask to a glass faceplate.

11 Claims, 10 Drawing Figures

FACEPLATE ASSEMBLY FOR SECURING A TENSION MASK SUPPORT STRUCTURE TO A FACEPLATE

CROSS-REFERENCE TO RELATED APPLICATIONS AND PATENTS

This application is related to but in no way dependent upon copending applications Ser. No. 808,137 filed Dec. 11, 1985; Ser. No. 828,568 filed Feb. 21, 1986; Ser. No. 831,699 filed Feb. 21, 1986 now U.S. Pat. No. 4,686,416; Ser. No. 835,845 filed Mar. 3, 1986; Ser. No. 866,030 filed May 21, 1986; Ser. No. 925,656 filed Oct. 29, 1986; Ser. No. 006,391 filed Jan. 23, 1987; Ser. No. 925,345 filed Oct. 31, 1986; and U.S. Pat. Nos. 4,547,696; 4,591,344; 4,593,224; 4,593,225; and 4,595,857, all of common ownership herewith.

This specification includes an account of the background of the invention, a description of the the best mode presently contemplated for carrying out the invention, and appended claims.

BACKGROUND OF THE INVENTION

1. Field of the Invention

This invention relates to color cathode ray picture tubes, and is addressed specifically to an improved faceplate assembly for tubes having shadow masks of the tension foil type mounted in association with a substantially flat faceplate. The invention relates also to a process for use in the manufacture of such tubes. The invention is applicable in color tubes of various types, including those used in home entertainment television receivers, and in medium-resolution and ultra-high resolution tubes intended for color monitors.

The faceplate assembly comprises the faceplate on the inner surface of which is located the screen with its deposits of electron-excitable red-light-emitting, blue-light-emitting and green-light-emitting phosphor elements. The faceplate assembly also includes a shadow mask, and support means for the mask. As used herein, the term "shadow mask" means an apertured metallic foil which may, by way of example, be about one mil thick, or less. The mask must be supported in high tension a predetermined distance from the inner surface of the cathode ray tube faceplate; this distance is known as the "Q distance." As is well known in the art, the shadow mask acts as a color-selection electrode, or parallax barrier, which ensures that each of the three beams projected by the electron gun lands only on its assigned phosphor elements on the screen.

The requirements for a support means for tensioned foil shadow masks mask are stringent. As has been noted, the foil shadow mask is normally mounted under high tension. The support means should be of high strength so the mask is held immovable; an inward movement of the mask in response to the high tension of the mask of as little as a few tenths of a mil is significant in expending guard band. The support structure must also be securely attached to the inner surface of the faceplate so that the structure will not pull away from the faceplate and lean inwardly under mask tension, in which case guardband would also be expended to the detriment of color purity.

Means for securing the shadow mask support to the inner surface of the faceplate may comprise a cement in the form of a devitrifying glass frit. While satisfactory in the main, cement of this type has significant disadvantages in that it is difficult to handle and apply in production, and it tends to create "pockets" in which screening fluids may lodge and be released later as contaminants. Also, the composition of the frit itself is subject to chemical breakdown when exposed to strong chemicals normally applied during the photoscreening process, and the byproducts of the breakdown may contaminate and poison the tube inner environment.

2. Prior Art

It is known in the cathode ray tube manufacturing art to install metal studs or pins in the skirt of a tube faceplate by forcing them into the softened glass of the skirt. The studs serve as suspension points for the bimetallic springs, usually three in number, that support the curved shadow mask suspended in association with the curved faceplate of the conventional cathode ray tube. An example of this technology is disclosed in U.S. Pat. No. 3,695,860 to Katuta entitled "Apparatus for Embedding Metal Pins in a Glass Panel." In essence, this automated apparatus comprises means for holding the pins in proper registry with the inside of the faceplate skirt, and means for flame-heating the embedding tips of the pins and, flame-heating the area of the skirt where the pins are to be installed. The areas of pin embedment in the skirt are heated to about 1150 degrees C., and the pins to about 1,050 degrees C. The pins, which are held in pin chucks, are then forced into the glass of the skirt by a ring-cam mechanism.

In U.S. Pat. No. 3,890,526 to Palac, of common ownership herewith, there is disclosed a faceplae mounting structure for a curved color selection electrode for a cathode ray tube having a curved faceplate. The mounting structure includes four sheet-metal studs comprising part of an electrode suspension device. The studs are embedded in the curved faceplate by a hot sealing operation. The disclosure includes a description of machine for installing the studs, which provides means for flame-heating the studs, and simultaneously, the areas of the faceplate which receive them, after which the studs are automatically pressed into the glass.

A glass-to-metal ceramic seal or bond is described by Daniel I. Pomerantz of the Mallory Laboratory for Physical Science, Burlington, Mass. A flat piece of glass is placed in contact with a flat piece of metal. The two pieces are heated to a temperature about 250 degrees C. below the softening point of the glass. A direct current is applied across the two parts to form what is in effect a capacitor, with the metal part polarized positive. The result is said to be a bonding of the two parts. No commercial application of this process to the cathode ray tube construction art is presently known. (Source: "Sealed with a Kilovolt," an article by David H. Surgan. *The Electronic Engineer,* September 1958. Pp. 16–17.)

OBJECTS OF THE INVENTION

It is an object of the invention to provide an improved faceplate assembly for a color cathode ray tube having a tensed foil shadow mask and a substantially flat faceplate.

It is object of the invention to provide a simplified process for attaching a tensed foil shadow mask support to a substantially flat faceplate.

It is another object of the invention to provide an improved faceplate assembly having a tensed foil shadow mask that is more securely mounted.

It is yet another object of this invention to provide means for permanently mounting a support structure for a shadow mask on a faceplate without the need for a special cement.

It is a further object of the invention to provide a process for securing a tensed foil shadow mask support to the faceplae inner surface that provides no pockets for the lodgment of contaminants during manufacture.

BRIEF DESCRIPTION OF THE DRAWINGS

The features of the present invention which are believed to be novel are set forth with particularity in the appended claims. The invention, together with further objects and advantages thereof, may best be understood by reference to the following description taken in conjunction with the accompanying drawings, in the several figures of which like reference numerals identify like elements, and in which:

DESCRIPTION OF THE PREFERRED EMBODIMENT

Figure 1:
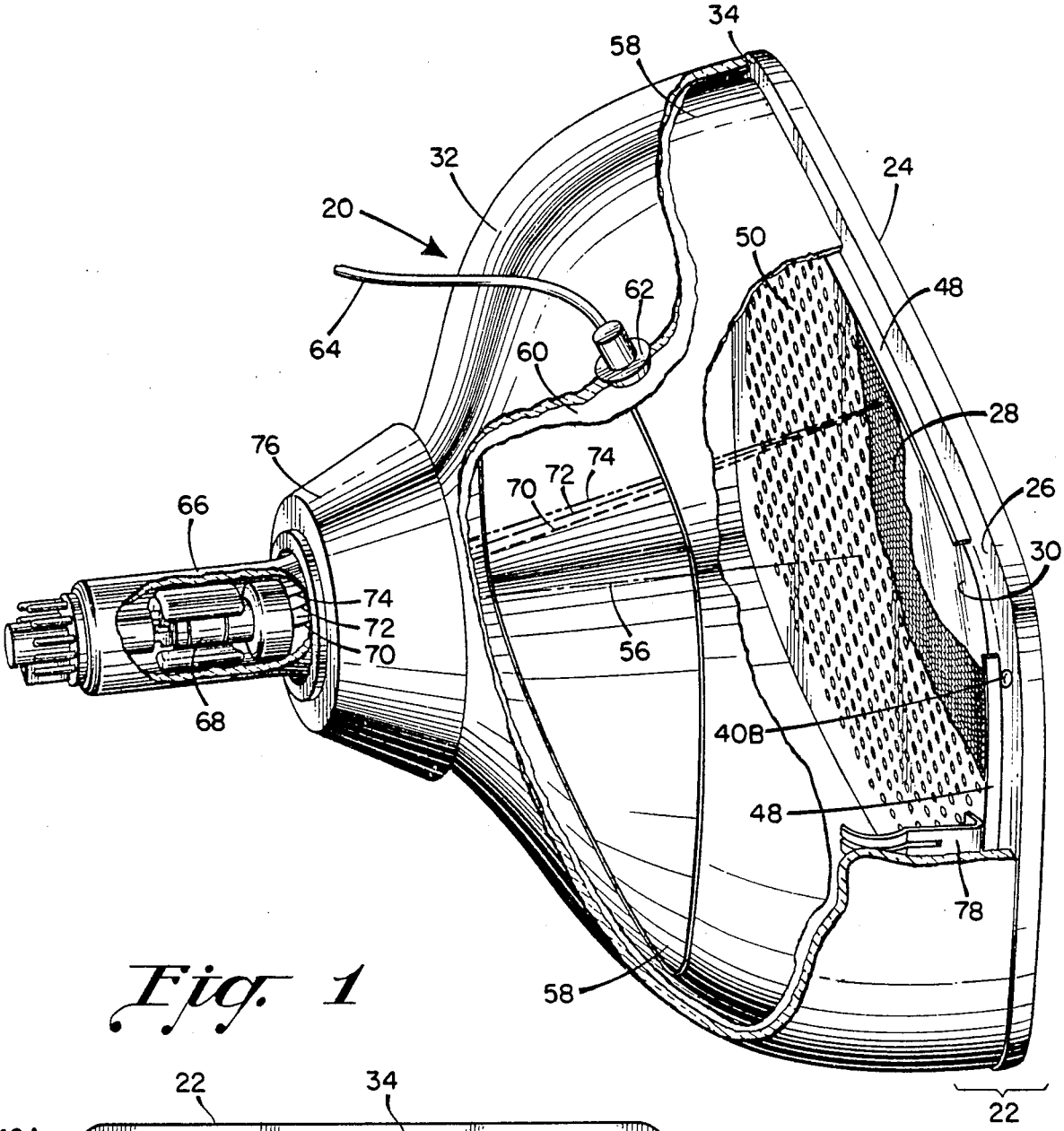
FIG. 1 is a side view in perspective of a color cathode ray tube having a faceplate assembly according to the invention, and a component of which is installed by the inventive process; cut-away sections indicate the location and relation of the faceplate assembly to other major tube components.

A cathode ray tube having an improved faceplate assembly according to the invention, and assembled according to the inventive process, is depicted in FIG. 1. The tube and its component parts are identified and described in the following paragraphs in this sequence: reference number, a reference name, and a brief description of structure, interconnections, relationship, functions, operation, and/or result, as appropriate.

Figure 2:
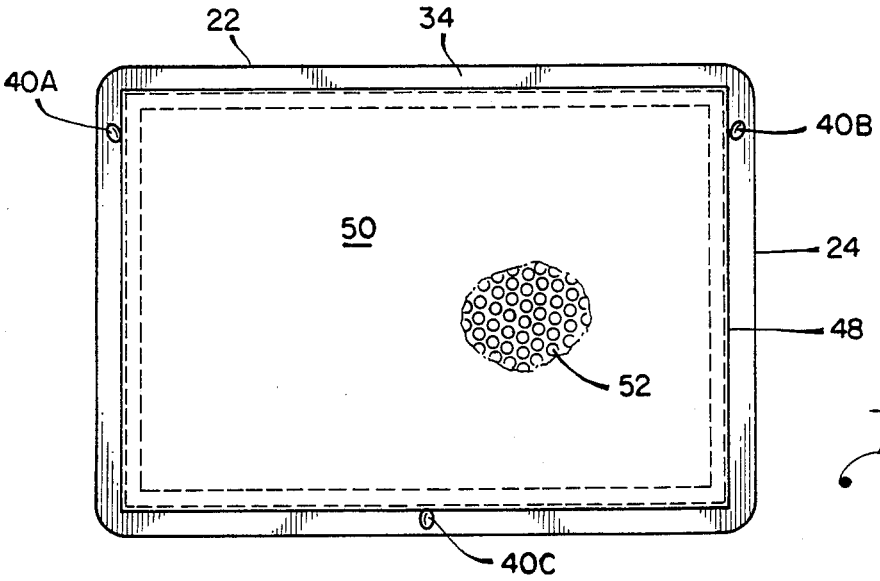
FIG. 2 is a plan view of the faceplate assembly of the tube shown by FIG. 1, and further depicting the relative locations of the faceplate, the shadow mask, and the mask support structure; an inset depicts mask apertures greatly enlarged.

(With initial reference to FIGS. 1 and 2.)

20 color cathode ray tube
22 faceplate assembly
24 faceplate
26 inner surface of faceplate
28 centrally disposed phosphor screen
30 film of aluminum
32 funnel
34 peripheral sealing area of faceplate, adapted to mate with a funnel
40A, 40B, 40C V-grooves, which are components of ball-and-groove indexing means shown by way of example for registering the faceplate with the funnel
48 frame-like shadow mask support structure, for receiving and securing a tensed foil shadow mask; the distance between the mask and the screen, which is determined by the height of the mask mounting surface of the support structure above the screen, is referred to as the "Q distance"
50 a metal foil shadow mask; after being tensed, the mask is mounted on frame-like support structure 48 and secured thereto; from the viewpoint of FIG. 2, shadow mask support structure 48 is shown by the dashed lines as underlying mask 50
52 shadow mask apertures, indicated greatly enlarged in the inset
56 anterior-posterior axis of tube
58 internal magnetic shield—"IMS"
60 internal conductive coating on funnel
62 anode button
64 high-voltage conductor
66 neck of tube
68 in-line electron gun providing three discrete in-line electron beams for exciting the triads of phosphors deposited on screen 28. The gun may be one of the types disclosed in referent copending applications Ser. No. 808,137 and Ser. No. 828,568
70, 72, 74 electron beams for activating respective red-light-emitting, green-light-emitting, and blue-light-emitting phosphor deposits on screen 28
76 yoke which provides for the traverse of beams 70, 72 and 74 across screen 28
78 contact spring which provides an electrical path between the funnel coating 60 and the mask support structure 48

In essence, the faceplate assembly 22 according to the invention for a color cathode ray tube comprises a glass faceplate 24 having on its inner surface 26 a centrally disposed phosphor screen 28. A foil shadow mask 52 is mounted in tension on a mask support structure located on opposed sides of the screen 28. Various configurations of a mask support structure can be installed according to the invention, as will be shown and described; one form of such a structure is support structure 48 hitherto described, and which is described and claimed in referent copending application Ser. No. 831,699. Whatever its form, a mask support physically penetrates the faceplate according to the invention for permanent, cementless anchoring of the structure of the faceplate, with the embedment of the structure being of such depth as to cause the structure to resist tensile forces created by the shadow mask. Also, the physical penetrating of the structure to a predetermined distance is effective to place the mounting surface of the support structure a predetermined Q distance from the faceplate inner surface.

Figure 3:
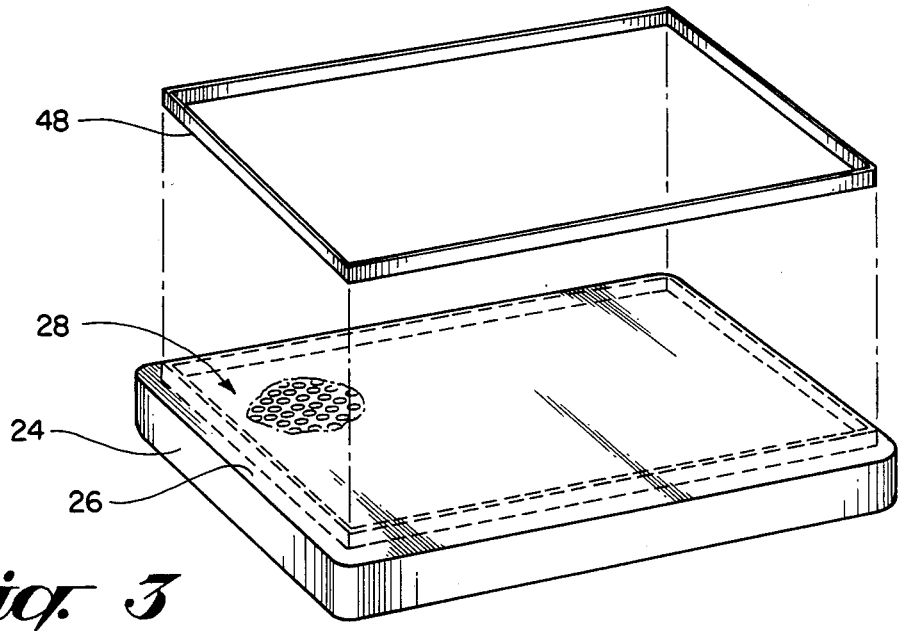
FIG. 3 is a view in perspective showing a flat, or substantially flat faceplate, with a frame-like tensed-foil shadow mask support structure indicated diagrammatically as being in position for placement on the faceplate inner surface; an inset indicates the screen on the inner surface.

With reference to FIG. 3, the faceplate 24 and mask support structure 48 of faceplate assembly 24 according to the invention shown in FIGS. 1 and 2 are depicted prior to being assembled. Shadow mask support structure 48 is shown ready to be positioned with respect to the inner surface 26 of faceplate 24, and on which is deposited a centrally disposed phosphor screen 28. When in position, support structure 48 will be seen as being located on opposed sides of the screen 28.

The support structure 48 depicted by FIG. 3 may be articulated in the corners. "Articulation," means that the structure is linked loosely at the corners; that is, it is so joined that it aids in accommodating a differential between the thermal coefficients of expansion that may exist between the metal of the support structure and the glass of the faceplate. The joining also retains the structure in a frame-like shape during the installation process.

Figure 4:
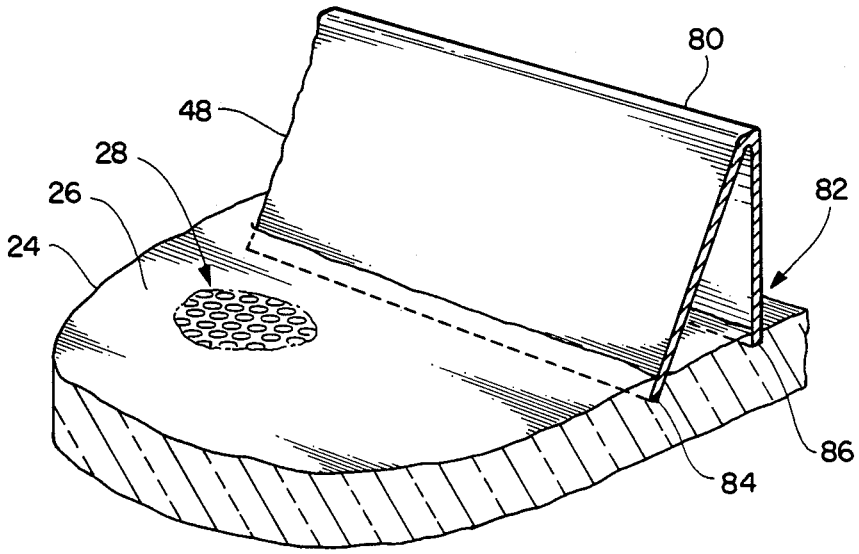
FIG. 4 is a perspective view showing in enlarged detail a section of the shadow mask support structure shown by the previous figures depicted as being secured according to the inventive process to the inner surface of the faceplate; an inset indicates the screen on the inner surface.

FIG. 4 shows in greater detail a section of support structure 48 and its relationship with the faceplate 24. Support structure 48 is indicated as being composed of sheet metal, and is depicted as including a mounting surface 80 for receiving and securing a shadow mask (not shown) in tension. A base portion 82 of support structure 48 is depicted as physically penetrating a predetermined distance into the faceplate 24 for permanent, cementless anchoring of support structure 48 to faceplate 24. The base portion 82 of this embodiment of a support structure is shown as comprising two legs 84 and 86, indicated by the dash lines as as physically penetrating faceplate 24. The embedment of the support structure can be of such depth as to cause the structure to resist tensile forces created by the shadow mask, and place the mounting surface at a predetermined Q distance from the faceplate inner surface. As has been noted, this configuration of a support structure is not the subject of the present invention, but is fully described in claimed in referent copending application Ser. No. 831,699. As will be shown, the support structure 48 depicted represents only one of several shadow mask support structure configurations that can be installed according to the invention.

The shadow mask support structure, indicated symbolically as being a metal, comprises a material having, according to the invention, a coefficient of thermal expansion compatible with the glass of the faceplate. A suitable metal is Carpenter Alloy No. 27 manufactured by Carpenter Technology, Inc. of Reading, Pa. The composition of this alloy is as follows:

Carbon—0.05%,
Manganese—0.60%,
Silicon—0.40%,
Chromium—28.00%,
Nickel—0.50% max.
Iron—Balance.

Another alloy with equivalent properties provided by another manufacturer may as well be used. At least the base portion of a support structure may comprise a material having a coefficient of thermal expansion compatible with the glass of the faceplate, and the base portion may comprise Carpenter Alloy No. 27. Alternately, the entire structure may be composed of Alloy No. 27, all according to the invention.

Figure 5:
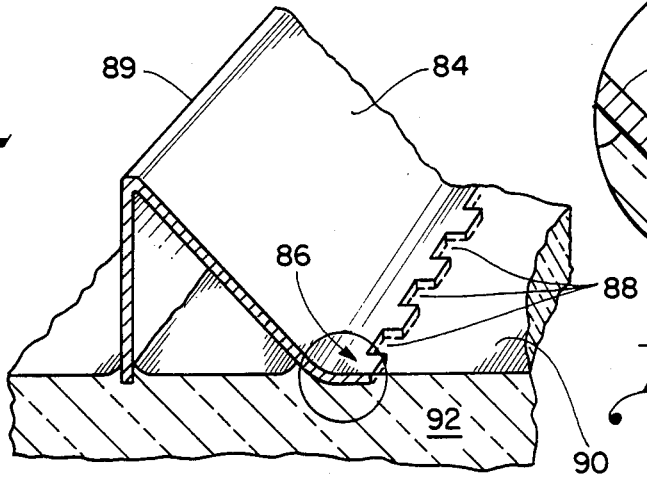
FIG. 5 is a view in perspective of a section of a faceplate and a shadow mask support structure according to the invention described and claimed in referent copending application Ser. No. 835,845, and showing the securement of the support structure to the inner surface of a faceplate according to the present inventive process; inset

A front assembly having a novel shadow mask support structure suitable for installation by the inventive process is described and claimed in referent copending application Ser. No. 835,845. FIG. 5 is a view in perspective of a shadow mask support structure excerpted from the '845 application. Support structure 84 resembles in some respects the support structure 48 heretofore described except that it has a foot 86 with a plurality of open-ended openings 88 therein. The foot 86 with its open-ended openings 88 provides, according to the '845 disclosure, cement-contactible edges for enhancing the securement of the support structure 84 to the inner surface 90 of faceplate 92, with the cement being, for example, a devitrifying glass frit. The foot and its open-ended openings could as well, according to the present invention, enhance the cementless anchoring of support structure 84 to faceplate 92 by physically penetrating a predetermined distance into faceplate 92.

Figure 5A:
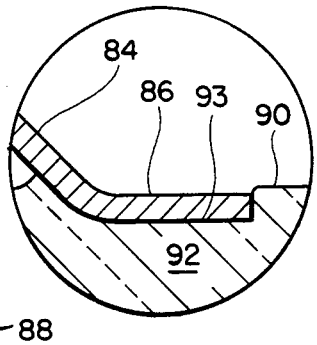
FIG. 5A depicts the encircled section of FIG. 5 in enlarged detail.

FIG. 5A depicts in greater detail the foot 86 of support structure 84. The base of the support structure 84, which comprises the foot 86 in this example, is depicted as physically penetrating a predetermined distance indicated as comprising by way of example a depth greater than the thickness of the base. Permanent securement of the support structure 84 is accomplished by the "wetting" of the metal by the glass, causing the metal and the glass to adhere at the interface 93; both the metal of the base and the glass have to be at the proper temperatures to provide such adherence, as will be described. The thickness of the sheet metal material which forms support structure may be 24 mils, by way of example. For material of this thickness, the depth of penetration of the foot may be in the range of 30 to 40 mils, also by way of example. This range is by no means limiting, as the depth of penetration may also depend upon the embedding of the support structure in the inner surface of the faceplate to a depth effective to place the shadow mask mounting surface 89 of support structure 84 at a predetermined Q distance from the inner surface 90 of faceplate 92. The range of depth of physical penetrating may be, by way of example, from a fraction of a mil to 150 mils or more, depending upon the type of support structure.

Figure 6:
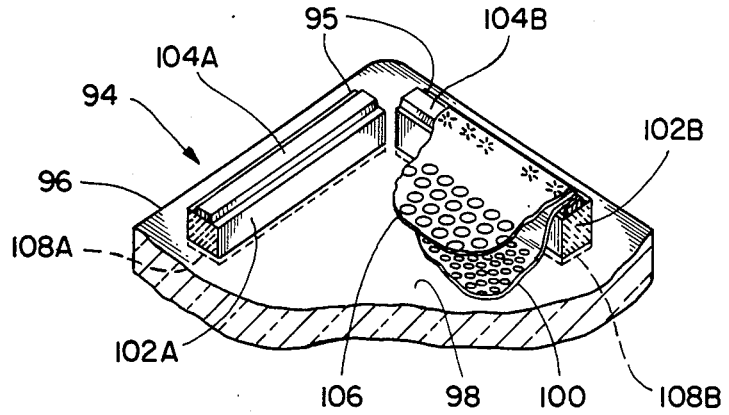
FIG. 6 is a perspective view of a corner section of the novel tensed foil shadow mask support structure according to the invention described and claimed in referent copending application Ser. No. 868,030, and showing the securement of the support structure to the inner surface of a faceplate according to the present inventive process.

Another embodiment of a front assembly having a novel support structure suitable for physically penetrating a faceplate according to the invention is shown by FIG. 6, which depicts a corner section of the front assembly 94 and the associated support structure 95, depicted as being in two sections in this view. This concept is fully described and claimed in referent copending application Ser. No. 866,030, of common ownership herewith. The embodiment shown by FIG. 6 represents yet another of the many available embodiments of a tensed foil shadow mask support structure that can be installed according to the invention; in this example, the structure is composed primarily of a ceramic material. The faceplate assembly 94 comprises a faceplate 96 on the inner surface 98 of which is deposited a centrally disposed phosphor screen 100. The support structure consists of four ceramic rails located on opposed sides of screen 100; two of the rails—rails 102A and 102B, are depicted in this corner view. Rails 102A and 102B are each indicated as having caps 104A and 104B, respectively, thereon. Caps 104A and 104B are indicated as comprising discrete metal strips which provide mounting surfaces for receiving and securing a foil shadow mask 106 in tension. The base portions 108A and 108B of the rails 102A and 102B are indicated by the dash lines as physically penetrating a predetermined distance into the glass of the faceplate 96 for permanent, cementless anchoring of the support structure to the faceplate. The support structure has a composition adapted for adherence to the glass; this composition is fully described and claimed in referent copending application Ser. No. 006,391. In some embodiments of the ceramic support structure, the physical penetration of the base into the faceplate 96 may be a predetermined distance of the order of fractions of a mil, by way of example, for the permanent, cementless anchoring of the support structure 95 to faceplate 96. In other embodiments, the depth of penetration may be much greater, with the depth depending upon the physical design of the structure, and whether it is desired that the depth of the penetrating be such as to position the mounting surfaces 104A and 104B at a predetermined distance from the inner surface 98 of faceplate 96, whereby the mounting surface(s) is positioned for receiving the foil shadow mask 106 in tension in appropriate spaced relationship to the faceplate inner surface 98.

Figure 7:
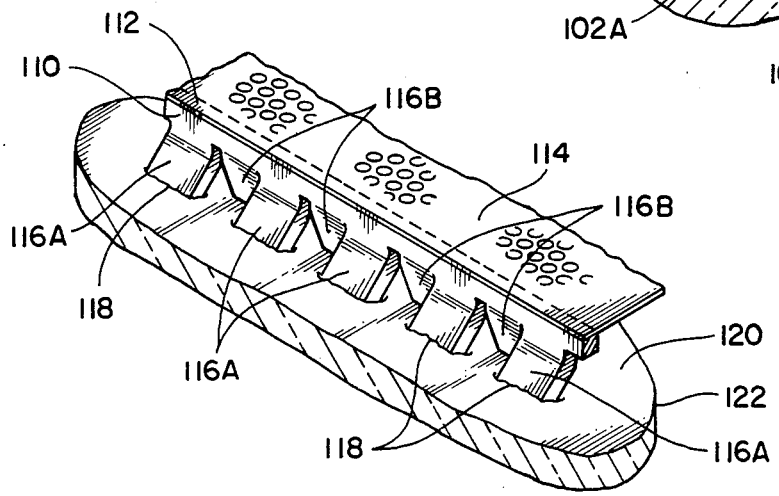
FIG. 7 is a view in perspective of a section of a faceplate showing a shadow mask support structure according to the invention described and claimed in referent copending application Ser. No. 925,345, and showing the securement of the support structure to the inner surface of a faceplate according to the present inventive process.

Another embodiment of a shadow mask support structure that can be installed according to the invention is depicted in FIG. 7, wherein there is shown a section of a tensed foil shadow mask support structure as mounted on the inner surface of a faceplate. This support structure concept is not the subject of the present invention but is fully described and claimed in referent copending application Ser. No. 925,345. The support structure 110 is depicted as comprising a mounting surface 112 for receiving and securing a shadow mask 114 in tension. A plurality of legs 116A and 116B are indicated as depending from a ridge that supports the mounting surface 112 to stabilize the support structure against the tensile forces imparted by the mask 114. Legs 116A and 116B are depicted as flaring outwardly from the mounting surface 112 in an alternating array on opposite sides thereof. The base portions 118 of legs 116A and 116B are shown as physically penetrating a predetermined distance into the inner surface 120 of faceplate 122 for permanent cementless anchoring of the support structure 110 to faceplate 122 according to the present invention.

Figure 8:
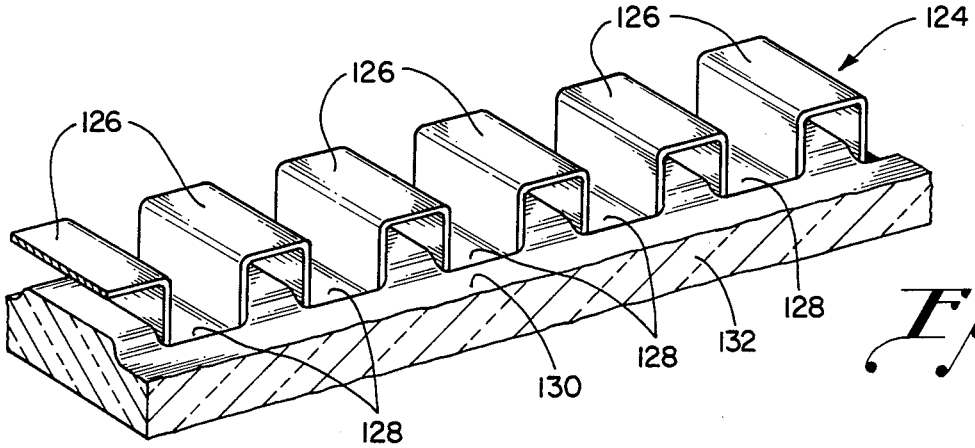
FIG. 8 is a view in perspective of a section of a faceplate in which a shadow mask support structure according to the invention described and claimed in referent copending application Ser. No. 925,345, and showing the securement of the support structure to the inner surface of a faceplate according to the present inventive process.

Yet another embodiment of a shadow mask support suitable for physically penetrating a predetermined distance into a faceplate according to the invention is shown by FIG. 8. This support structure concept is described and fully claimed in referent copending application Ser. No. 925,656, also of common ownership herewith. The support structure 124 comprises an undulated member that defines peaks 126 and valleys 128, both shown as being flattened, with the flattened tops of peaks 126 providing a mounting surface for receiving and securing a foil shadow mask in tension. The valleys 128, or base portions, of support structure 124 are indicated as physically penetrating the glass of the inner surface 130 of the faceplate 132. The support structure 124 is preferably formed from an elongated strip of metal which may comprise the aforedescribed Carpenter Alloy No. 27.

A process according to the invention for securing a support structure for a tensed foil shadow mask to a flat glass faceplate having a centrally disposed phosphor screening area on an inner surface thereof comprises the following:

providing a frame-like support structure for receiving and supporting the shadow mask in tension, the support structure having a mounting surface suitable for securing the mask thereon, and a base portion adapted for physically penetrating the faceplate;

conditioning the faceplate to be physically penetrated by the support structure by heating the faceplate to a predetermined temperature in the range between the strain point temperature and the annealing point temperature of the glass;

positioning the support structure on opposed sides of the screen, and locating and resting the structure against the inner surface;

heating the support structure by electrical resistance to the working point temperature of the glass and pressing the structure into the glass through the inner surface, causing the base portion to penetrate to a depth effective both to permanently secure the structure to the faceplate against the tensile forces imparted by the mask, and to position the mounting surface at a predetermined Q-distance from the faceplate inner surface. As a result, the mounting surface is positioned for receiving the foil shadow mask in tension in approriate spaced relationship to the faceplate inner surface, and for mounting the foil mask in tension on the mounting surface after the disposition of the phosphor screen on the inner surface.

Concerning the "conditioning" of the faceplate, the preferred temperature range of the glass of a faceplate for the installation of a support structure according to the invention is, by way of example, between 462 degrees Centigrade—the strain point of standard faceplate glass, and 503 degrees Centigrade—the annealing point of standard faceplate glass. The temperatures cited comprise the normal range for glass used in the faceplates of color cathode ray tube. A cold faceplate may be brought to the desired temperature by heating in an oven. Alternately, and more cost effectively, the installation of the support structure according to the invention may be accomplished in the interim when the faceplate is taken from the mold and before it is put into the annealing oven. During the interim, the faceplate is allowed to cool to the desired temperature range during which a support structure can be installed.

With regard to the temperature of the support structure that is pressed into the glass of the inner surface according to the inventive process, if Carpenter Alloy No. 27 is used, the recommended temperature to which the support structure should be heated is about 1000 degrees Centigrade—the working point of faceplate glass; this is equivalent to a red heat for the Carpenter No. 27 Alloy. Heating of the support structure, if metal, to the proper temperature is preferably by electrical resistance; also feasible are heating by induction or by means of an oven. The temperatures to which the support structure and the glass are heated are preferably those that will provide the necessary "wetting" of the contacting surfaces to effect proper adherence and permanent anchoring of the support structure to the faceplate. In addition, at the temperatures and temperature ranges described, the base portion of a support structure can readily physically penetrate the glass of the faceplate.

Figure 9:
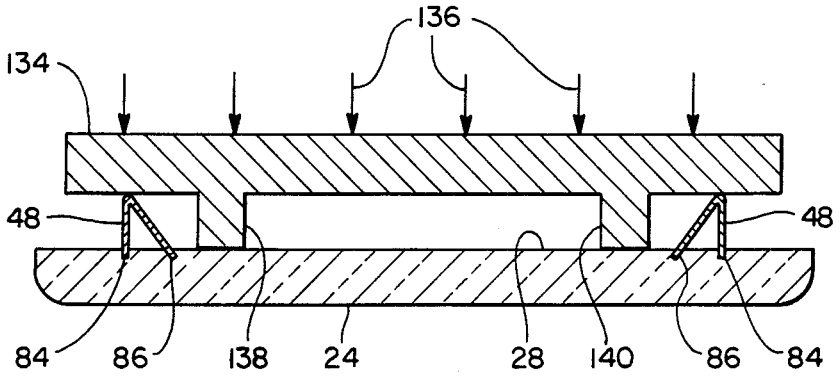
FIG. 9 is a view in section and in elevation depicting an apparatus used in the process according to the invention for installing a shadow mask support structure.

FIG. 9 is a diagrammatic depiction of an apparatus suitable for the physical penetration according to the invention of a support structure into a faceplate. It will be observed that the support structure 48, shown by way of example, is the support structure shown by FIGS. 1–4. The structure is noted as comprising a base portion 82 having two legs 84 and 86, depicted as physically penetrating faceplate 24. Means for the accomplishing physical penetration is depicted schematically as comprising a metal plate 134 which, as indicated by the arrows 136, represents the physical penetrating of the base portion 82 of support structure 48 into the glass of the inner surface 28 of the faceplate 24 according to the invention. Shims 138 and 140 are depicted as controlling the depth of penetration of the support structure to place the mounting surface of the structure at a predetermined Q-distance from the inner surface 28 of faceplate 24. The positioning of the support structure with respect to its proper location on the inner surface of the faceplate may be accomplished by a suitable fixture which holds the support structure 48 during heating, and ensures that it is in proper registry when it is lowered onto the inner surface 28 of faceplate 24. The construction of such a fixture for all configurations of support structures is well within the capabilities of those skilled in the art of cathode ray tube manufacture.

While a particular embodiment of the invention has been shown and described, it will be readily apparent to those skilled in the art that changes and modifications may be made in the inventive means and process without departing from the invention in its broader aspects, and therefore, the aim of the appended claims is to cover all such changes and modifications as fall within the true spirit and scope of the invention.

What is claimed is:

1. A faceplate assembly for a color cathode ray tube comprising a glass faceplate having on its inner surface a centrally disposed phosphor screen, and a foil shadow mask mounted in tension on a mask support structure located on opposed sides of the screen, said mask support structure physically penetrating said faceplate for permanent, cementless anchoring of said structure to said faceplate, with the embedment of said mask support structure being of such depth as to cause said structure to resist tensile forces created by said mask.

2. The faceplate assembly according to claim 1 wherein said support structure comprises a material having a coefficient of thermal expansion compatible with that of said glass.

3. The faceplate assembly according to claim 2 wherein said material of said support structure is a metal alloy.

4. The faceplate assembly according to claim 1 wherein said support structure is composed of a ceramic.

5. The faceplate assembly according to claim 1 wherein said support structure physically penetrates said faceplate a predetermined distance effective to provide a predetermined Q distance between said shadow mask and said screen.

6. A faceplate assembly for a color cathode ray tube comprising a glass faceplate having on its inner surface a centrally disposed phosphor screen, and a foil shadow mask mounted in tension on a mask support structure located on opposed sides of said screen, said support structure including a mounting surface for receiving and securing said mask in tension, and a base portion physically penetrating a predetermined distance into said faceplate for permanent, cementless anchoring of said support structure to said faceplate, with the embedment of said mask support structure being of such depth as to cause said structure to resist tensile forces created by said mask, and to place said mounting surface at a predetermined Q distance from said faceplate inner surface.

7. The faceplate assembly according to claim 6 wherein at least said base portion of said support structure comprises a material having a coefficient of thermal expansion compatible with that of said glass.

8. The faceplate assembly according to claim 7 wherein said material of said base portion is a metal alloy.

9. The faceplate assembly according to claim 6 wherein said support structure comprises a ceramic.

10. A faceplate assembly for a color cathode ray tube comprising a glass faceplate having on its inner surface a centrally disposed phosphor screen, and a foil shadow mask mounted in tension on a metal mask support structure located on opposed sides of said screen, said metal of said support structure having a coefficient of thermal expansion compatible with said glass of said faceplate, said support structure including a surface for receiving and securing said mask in tension, and a base portion physically penetrating a predetermined distance into said faceplate for permanent, cementless anchoring of said support structure to said faceplate, with the embedment of said mask support structure being of such depth as to cause said structure to resist tensile forces created by said mask, and to place said mounting surface at a predetermined Q distance from said faceplate inner surface.

11. A faceplate assembly for a color cathode ray tube comprising a glass faceplate having on its inner surface a centrally disposed phosphor screen, and a foil shadow mask mounted in tension on a ceramic mask support structure located on opposed sides of said screen, said ceramic of said support structure having a composition adapted for adherence to said glass of said face plate, said support structure including a mounting surface for receiving and securing said mask in tension, and a base portion physically penetrating a predetermined distance into said faceplate for permanent, cementless anchoring of said support structure to said faceplate.

* * * * *